United States Patent [19]

Abdou

[11] 4,063,053

[45] Dec. 13, 1977

[54] ADJUSTING AND SEALING MEANS FOR HIGH PRESSURE GAS STORAGE TANK

[75] Inventor: John J. Abdou, Brandon, Miss.

[73] Assignee: Allis-Chalmers Corporation, Milwaukee, Wis.

[21] Appl. No.: 635,159

[22] Filed: Nov. 24, 1975

[51] Int. Cl.[2] ..... H01H 33/82

[52] U.S. Cl. ..... 200/148 R; 200/148 B

[58] Field of Search ..... 200/148 R, 148 B, 148 E, 200/148 F; 285/226, 302; 52/758 F; 174/161 R; 403/4, 337, 408

[56] References Cited

U.S. PATENT DOCUMENTS

| | | | |
|---|---|---|---|
| 1,367,347 | 2/1921 | Barnes | 285/302 |
| 2,335,478 | 11/1943 | Bergman | 285/226 |
| 2,435,162 | 1/1948 | Scott, Jr. | 200/148 R |
| 2,889,396 | 6/1959 | Boden et al. | 174/161 R |

*Primary Examiner*—Robert K. Schaffer
*Assistant Examiner*—Michael Mutter
*Attorney, Agent, or Firm*—Robert C. Jones

[57] ABSTRACT

A high pressure insulated cylindrical gas storage tank is adapted to store gas at a relatively high pressure and also to support the associated interrupter and blast valve assembly which is mounted within a relatively low pressure tank. To facilitate alignment and adjustment of various associated components, upper and lower sealing and adjusting assemblies are provided. The adjusting and sealing units provide the capabilities for affecting radial, angular and vertical adjustment necessary for alignment of the high pressure tank axis with respect to the longitudinal axis of the interrupter and blast valve assembly and the vertical axis of the blast valve housing which is part of the interrupter and blast valve assembly.

9 Claims, 4 Drawing Figures

ADJUSTING AND SEALING MEANS FOR HIGH PRESSURE GAS STORAGE TANK

BACKGROUND OF THE INVENTION

In EHV gas insulated circuit breakers rated for 362–550 KV installations, three or more serially connected interrupters are utilized to interrupt the current. These interrupters and the associated blast valve components and operating linkages are supported within the sealed enclosure by individual storage tanks which contain gas at relatively high pressure for effecting arc extinction. In these type of circuit breakers, the interrupters are relatively large and heavy. In addition, the blast valve castings are likewise large and are also heavy. In manufacturing these components, there is a certain amount of dimensional variance that occurs due to manufacturing tolerances. Thus, to effect mating engagement of these components within the circuit breaker enclosure and to attain operating alignment requires adjustment of the parts. In addition, the pull-rod assembly through which the closing and opening movement of the interrupter and associated blast valve is obtained requires substantial straight line alignment. The pull-rod assembly must be also connected by means of linkages to the interrupter contact and to the blast valve. All of these operating components must be mated and connected together without undue stresses and misalignments so that binding and interference between the components does not occur. Since the interrupter and blast valve are supported on the high pressure gas storage tank, the adjustment affected between components to obtain mating engagement and free acting connections may strain or stress the high pressure storage tank or may result in stress in the component.

The present invention provides a novel arrangement for obtaining adjustment of the storage tank relative to its supporting base and also for alignment of it with respect to the interrupter and blast valve assembly.

BRIEF SUMMARY OF THE INVENTION

In accordance with the present invention, a novel adjusting and sealing means is provided to adjustably support and seal the base of the cylindrical storage tank on its supporting base. This adjusting and sealing means provides radial adjustment of the tank and also provides the capability of affecting angular adjustment of the axis of the storage tank in all directions. With this arrangement, the storage tank may be bodily shifted in any radial direction and its axis can be tilted in any direction desired. In addition, an upper adjusting and sealing means for the storage tank is provided which provides the capability for affecting the radial adjustment of the components supported on the storage tank. This adjusting means also permits adjusting of the components supported on the storage tank in an axial direction. Thus, the relative position of the storage tank itself can be varied radially in any direction necessary and its axis may be tilted in any desired direction so that mating engagement of the supported components can be easily obtained. In addition, the supported component itself may be adjusted in two planes to provide additional capabilities.

DESCRIPTION OF THE INVENTION

Figure 1:
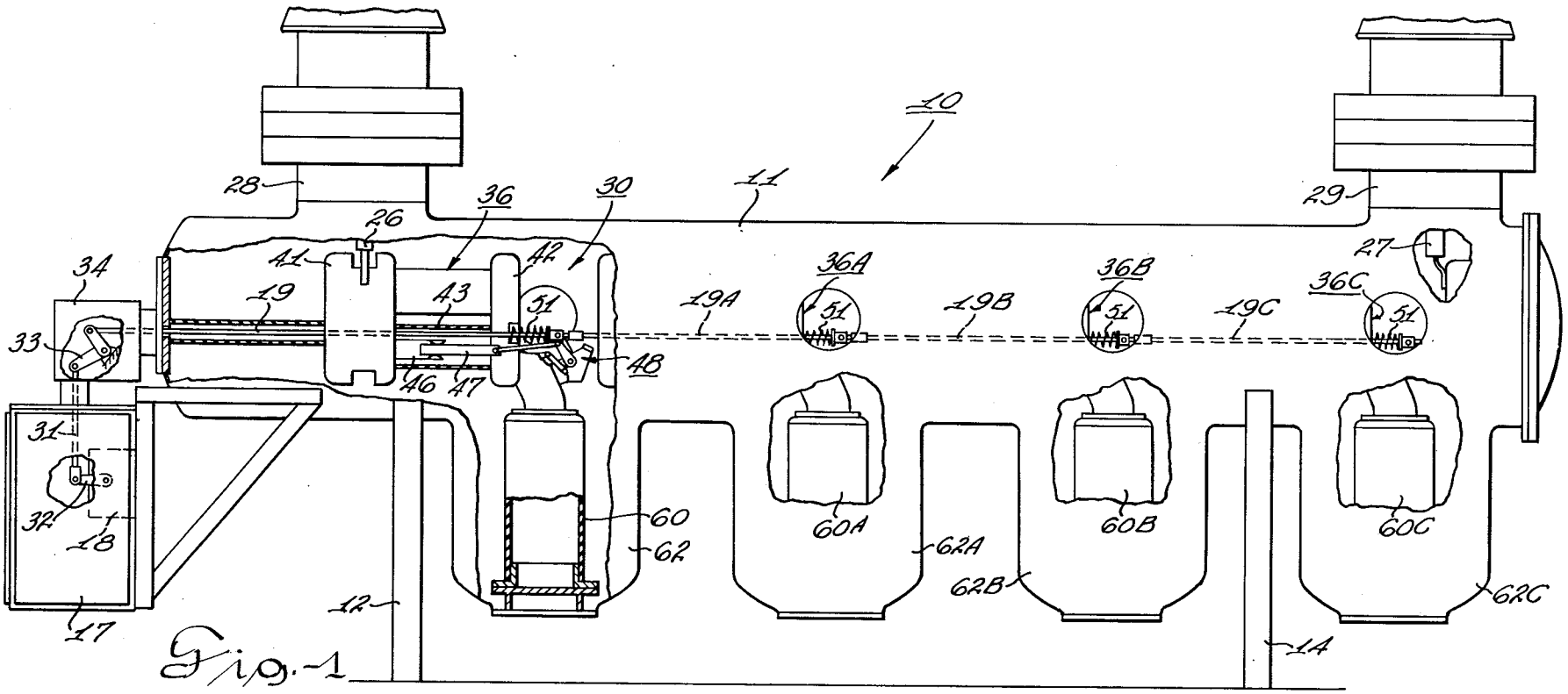
FIG. 1 is a view in side elevation of a gas insulated circuit breaker with portions of the enclosure being broken away to show the arrangement of the interrupters therein and the supporting high pressure storage tank.

Referring to FIG. 1, there is shown a gas insulated circuit breaker 10 in which the present invention is incorporated. The circuit breaker 10 in general includes an elongated gas tight enclosure 11 which is mounted on supports 12 and 14.

Adjacent the left end of the enclosure 11 is an operating mechanism housing 17 in which among other equipment is an operating mechanism 18. The operating mechanism 18 is operable upon the signal to effect longitudinal movement of an interconnecting pull-rod 19 disposed in the enclosure 11 and extending parallel to the longitudinal axis of the enclosure. Terminal bushings 26 and 27 extend downwardly into the interior of the enclosure 11 through cylindrical supports 28 and 29.

The interior ends of the terminal bushings 26 and 27 as exemplified by the bushing 26 are electrically connected to each end of an arc extinguish assembly 30, but do not support the assemblage.

The operating mechanism 18 within the housing 17 is operatively connected to pull-rod 19 by means of a vertical rod 31, the lower end of which is pivotally connected to an operating lever 32 of the mechanism 18. The upper end or opposite end of the rod 31 is pivotally connected to one end of a pivotally mounted bell crank 33 that is located within a motion transfer box 34. The other end of the bell crank 33 is pivotally connected to the end of the pull-rod 19. The pull-rod 19 is arranged to effect simultaneous movement of the contacts of the plurality of interrupters 36, 36A, 36B and 36C in an opening and closing movement.

Each of the interrupters 36, 36A, 36B and 36C are identical and their construction and arrangement are exemplified by the arrangement of the interrupter 36. The interrupter 36 in general comprises a forward shield casting 41 and a rearwardly located shield casting 42 between which is secured an insulating cylinder contact housing 43. The interrupter unit includes a relatively stationary contact structure 46 that is cooperable with a relatively movable tubular contact structure 47. The movable contact 47 is actuated between an open and closed position by linkage means 48 operatively connected to the substantially centrally disposed longitudinally extending pull-rod 19. It will be understood that each of the other interrupters also include pull-rods 19A, 19B and 19C, respectively. All of the pull-rods 19, 19A, 19B and 19C are releasably connected together so as to move as a single unit to effect the simultaneous operation of the associated movable contacts. An acceleration spring 51 is mounted around the pull-rod 19 at the right hand end thereof. As shown in detail in FIG. 2, the acceleration spring 51 is a compression spring having one end abutting an adjustable spring retainer 52. The opposite end of the spring 51 abuts the bottom surface of a recess 53 formed around an opening 54 through which the pull-rod 19 extends. Thus, operation of the operating mechanism 18 in a first mode will effect the movement of the pull-rods in a first direction or to the left, as viewed in FIG. 1, to close the contacts of the interrupters and to also charge the accelerating springs 51 associated with the serially connected interrupters. When the operating mechanism 18 is tripped, the storage energy in the several acceleration springs 51 will be released to move the pull-rods in a second direction or to the right, as viewed in FIG. 1, to effect the movement of several contacts to an open position thereby establishing a plurality of serially related arcs.

Extinction of the arcs drawn between the contacts of the several interrupters in the arcing area at the axial end of the movable contacts 47 is aided by means of a blast of high pressure gas to the arcing area. To this end, gas blast valve means 56 provides a blast of high pressure gas to the arcing area via a passage 57, FIG. 2, surrounding the movable contact 47 to effect a rapid extinction of the arc.

The blast of high pressure gas is released by operation of a blast valve member 58. The opening operation of the blast valve member 58 in synchronism with the opening of the contact 47 is accomplished by linkage 59. The linkage 59 is connected to the contact linkage 48 and operates in unison therewith upon movement of the pull-rod 19 in its second direction to open the contacts. As the contacts part, the several blast valves are open so that a blast of gas at a relatively high pressure is directed to the arcing area as previously mentioned.

Gas at a relatively high pressure for effecting the extinction of the arc drawn between the open contacts of the several interrupters is obtained from a cylindrical storage tank 60 which is of an insulating material. Each of the interrupters includes an independent high pressure gas storage tank 60, 60A, 60B and 60C. Thus, each interrupter is an independent unit operating in synchronism with all the other interrupter units. The failure of one high pressure gas supply does not affect the remaining interrupters.

In addition, the storage tanks 60 serve as a main support for the interrupters 36 and the blast valves 56 as well as the linkages 48 and 59.

The storage tanks 60 are disposed and supported within cylindrical extensions 62 which are welded to the bottom of the elongated cylindrical enclosure 11.

Figure 2:
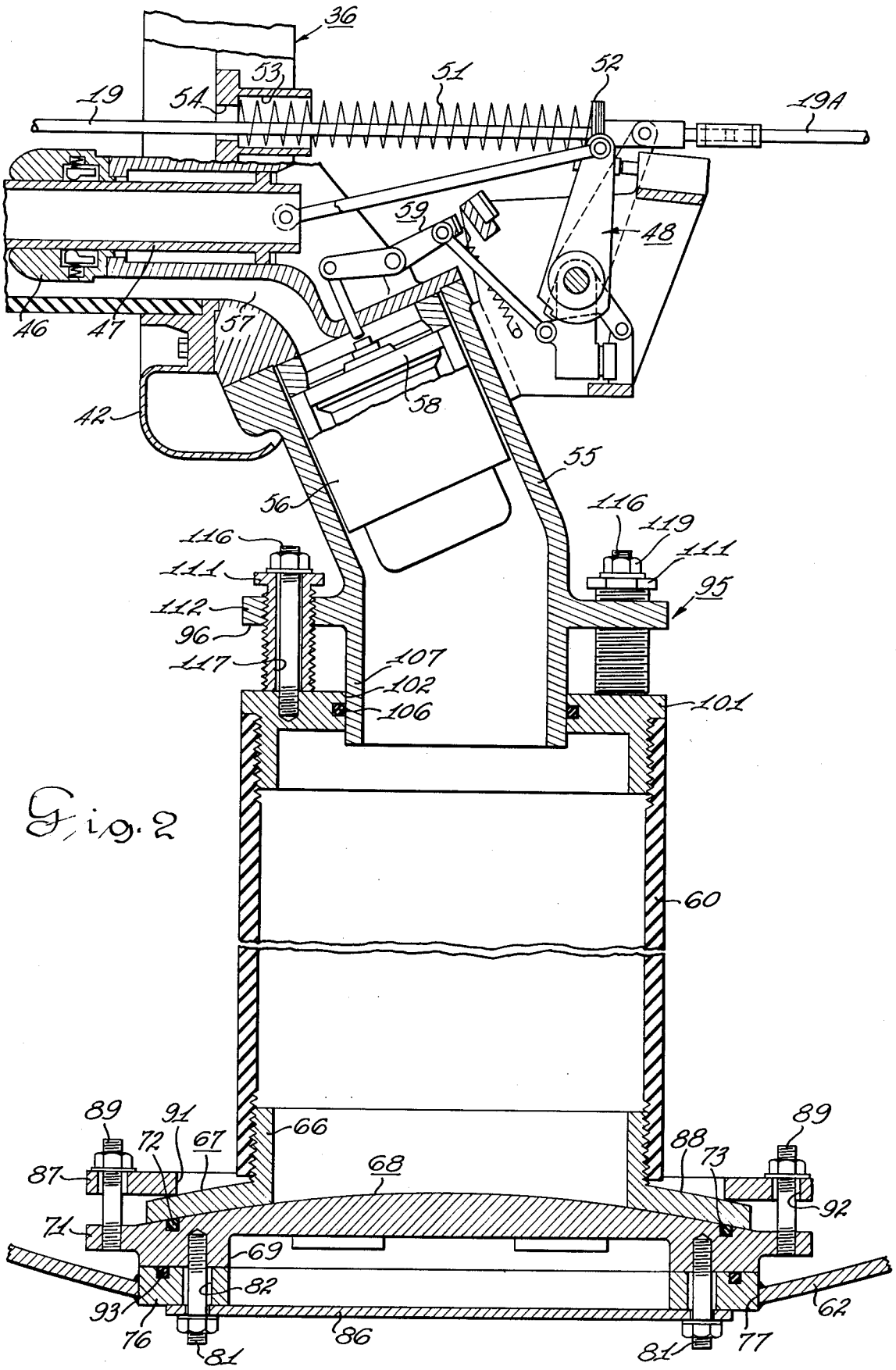
FIG. 2 is an enlarged view partly in vertical section and partly in elevation through an interrupter and an associated high pressure gas storage tank support.

As shown in greater detail, FIG. 2, the high pressure gas storage tank 60 has its lower end threadedly secured to a threaded tubular extension 66 of a spherical configured supporting member 67. The spherical configured supporting member 67, in turn, mates with and is supported on a complementary spherical configured supporting base 68 that has a circular downwardly extending flange 69 and a radially outwardly extending bolt flange 71. To seal the space or joint surface between the member 67 and the member 68, an O-ring 72 is seated within an annular groove 73 formed in the spherical surface of the supporting base 68. The supporting base 68, in turn, is disposed on an annular ring 76 which is welded within a circular opening 77 formed in the bottom of the extension 62.

The supporting base 68 is adjustably secured in position on the annular ring 76 by means of a plurality of bolts 81. The bolts 81 extend through openings 82 formed in the annular ring 76 and are threadedly engaged in suitable threaded openings in the base 68. As will be noted, the diameter of the openings 82 are larger than the diameter of the bolts 81. This permits the base 68 to be radially adjusted in any direction relative to the annular ring 76. Thus, the axis of the high pressure storage tank 60 can be varied radially in any direction as desired. A closure plate 86 is provided to close the equipment space formed by the depending flange 69 of the base 68 and the annular ring 76.

A clamp ring 87 surrounds the tank 60 and engages the spherical surface formed on the support member 67. A plurality of bolts 89 are provided to effectively secure the clamp ring in position for securely clamping the support member 67 in its adjusted position on the support base 68. It is to be noted that the bore 91 of the clamp ring 87 is much larger in diameter in relation to the O.D. of the tank 60. This is done to ensure that no interference occurs between the members when the base 68 with the tank 60 thereon is adjusted radially. It is further to be noted that the bolt openings 92 in the peripheral edge of the clamp ring 87 through which bolts 89 extend have a diameter which is larger than the diameter of the bolts 89. This construction is provided to ensure that the clamp ring 87 can operate to secure the support member 67 to the base 68 in any adjusted position of the members 67 and 68.

The joint surface between the annular support ring 76 and the surface of the depending flange 69 of the base support 68 is sealed by an O-ring 93.

At the upper end of the storage tank 60 another adjustable and sealing means 95 is provided. The upper adjusting means provides for vertical adjustment of the blast valve housing 55 relative to the storage tank 60. Thus, a variation in the dimensional spacing between the joint face 96 of the interrupter, which face is adapted to mate with the joint face 97 of the blast valve housing 55, and the upper end of the storage tank 60 can be compensated for by adjusting the blast valve housing 55 vertically.

To this purpose, the upper end of the storage tank 60 threadedly receives a mounting base 101 having an axial opening 102. The tubular end 107 of the blast valve housing 55 is adapted to be received in the opening 102 of the mounting base 101. An O-ring 108 is operable to effectively seal the joint surface between the surface of the tubular end 107 and the surface of the opening 102. Axial adjustment of the blast valve housing is effected by means of a plurality of adjusting screws 111. The adjusting screws are threadedly engaged in suitable openings formed in a radially extending flange 112 integrally formed or otherwise secured to the blast valve housing 55. Thus, by selective adjustment of the screws 111 the vertical position of the blast valve housing 55 may be adjusted to accommodate the dimensioned spacing between the surface 96 with which the blast valve housing 55 mates and the upper end of the storage tank 60.

To secure the blast valve housing 55 to the storage tank 60 there is provided a plurality of studs 116 one of which is associated with each of the adjusting screws 111. As shown, each adjusting screw 111 is formed with an axial bore 117 of a diameter which is larger than the diameter of the stud 116. The stud extends through the bore 117 into threaded engagement in the support base 101. With the blast valve housing 55 adjusted in a vertical plane and in a horizontal plane, it can be secured in its adjusted position by operation of nuts 119. The nuts 119 are threadedly engaged on the external end of the associate stud 116 and engage the enlarged heads of the adjusting screws 111 and effectively clamp the housing 55 in position.

Figure 3:
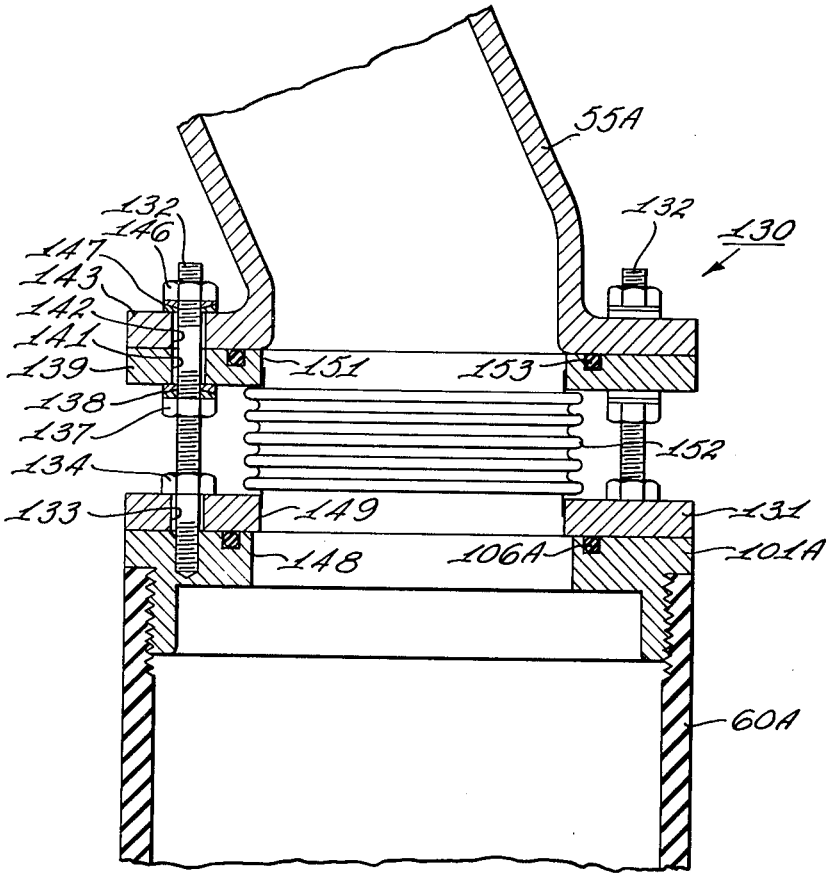
FIG. 3 is an enlarged view in vertical section of the modified arrangement of an upper storage tank adjusting and sealing means; and, FIG. 4 is an enlarged view in vertical section showing the modified arrangement of a lower adjusting and sealing means.

In FIG. 3 a modified arrangement of an upper adjusting and sealing means 130 is disclosed. The adjusting and sealing means 130 comprises a lower collar ring 131 which is adapted to seat on a support base 101A similar to the base 101. The base 101A is threadedly secured in gas tight relationship to the upper end of the gas storage tank 60A. An O-ring 106A serves to seal the joint surface between the supporting base 101A and the lower collar ring 131.

Threadedly engaged in and upstanding from the supporting base are a plurality of spaced apart studs 132. Each stud 132 passes through an opening 133 formed in the lower collar ring 131. The opening 133 has a diameter which is larger than the diameter of the stud 132. Thus, with the openings 133 larger than the diameter of the studs, the radial adjustment of the lower collar ring 131 in any direction may be achieved. Lower nut members 134 threaded on the lower portion of the studs 131 serve to clamp the lower collar ring 131 in an adjusted position.

Threadedly engaged on and spaced from the nut 134 is a nut 137 against which an adjustable washer set 138 abuts. Supported on the adjustable washer set 138 is an upper collar ring 139. The collar ring 139 is formed with a plurality of stud openings 141 through which the studs 132 pass. The studs 132 extend further upwardly and pass through openings 142 formed in a radially extended flange 143 of the blast valve housing 55A. It will be noted that the openings 141 in the upper collar ring 139 and the openings in the flange 143 of the blast valve housing 55A are of the same diameter as the diameter of the openings 133 in the lower collar ring 131. Thus, the lower collar ring 131, the upper collar ring 139 and the blast valve housing 55A all may be adjusted radially in any direction either independently of each other or together as a unit. To clamp the blast valve housing 55A in an adjusted position there is provided clamp nuts 146 threaded on the outer ends of the studs 132 and which engage against adjusting washer sets 147. Thus, by relative movement of the lower nuts 137, the angular orientation of the blast valve housing 44A may be varied as conditions warrant.

Communication between the gas storage tank 60A and the interior of the blast valve housing 55A is through axial openings 148, 149 and 151 formed in the supporting base 101A, the lower collar ring 131 and the upper collar ring 139, respectively.

To provide a sealed gas tight passage between the upper and lower collar rings there is provided a flexible bellows 152. The bellows 152 is welded to the wall surfaces of the openings 149 and 151. With this arrangement, the lower and upper collar rings 131 and 139 may be moved radially independent of each other or together as conditions require. Also the upper collar ring 139 may be tilted angularly in any direction or moved vertically as required without impairing the seal passage between the storage tank 60A and the housing 55A. An O-ring 153 operates to provide a gas tight seal between the adjacent surfaces of the flange 143 and upper collar ring 139.

Figure 4:
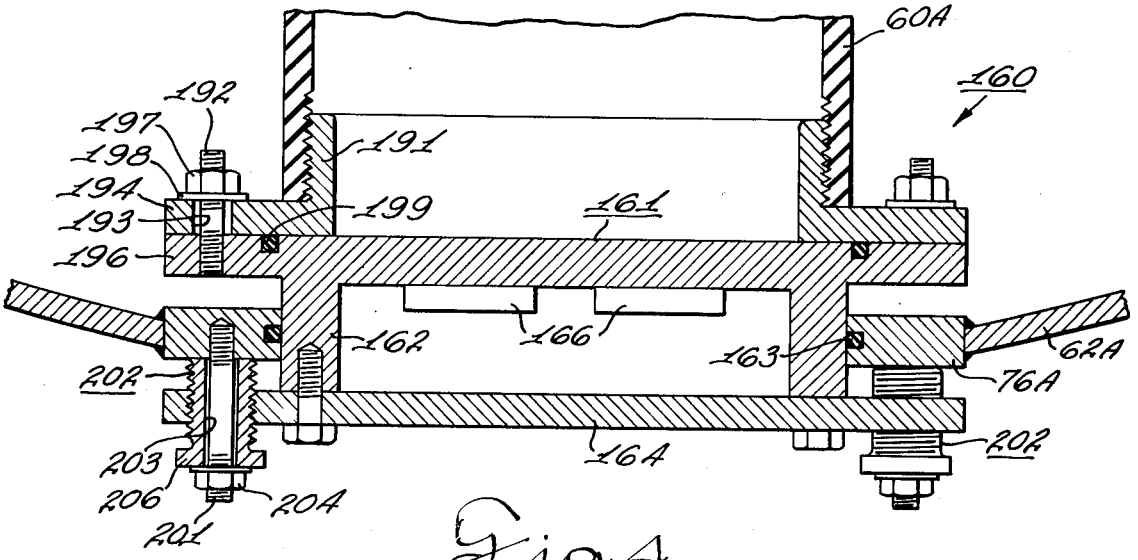

In FIG. 4, a modified arrangement of a lower adjusting and sealing means 160 is disclosed which is particularly well adapted for utilization with the upper adjusting and sealing means 130 shown in FIG. 3. The adjusting means 160 includes a supporting base 161 having a downwardly depending circular collar 162. The circular collar 162 is slidable within an annular ring 76A which is welded within the circular opening provided in the enclosure extension 62A. An O-ring 163 operates to provide a gas tight seal between the annular ring 76A and the collar 162. A closure plate 164 is screw fastened to the bottom surface of the circular collar 162. This arrangement gives protection to auxiliary components such as heaters 166 and the like located within the space defined by the collar.

Threadedly secured in gas tight relationship to the lower end of the storage tank 60A, which is of insulating material, is a support member 191. Studs 192 extend through openings 193 formed in the radially outwardly extending flange portion 194 of the support member 191. The studs 192 are threadedly engaged in an outwardly extending radial flange portion 196 of the support base 161. It will be noted that the diameter of the openings 193 are larger than the diameter of the studs 192. This arrangement permits adjusting the storage tank radially in any direction on the support base 161. Nuts 197 acting on washers 198, of relatively large external diameters, operate to clamp the storage tank 60A in an adjusted position on the support base 161. An O-ring 199 operates to seal the abutting joint surfaces between the support member 191 and the support base 161.

Vertical adjustment of the storage tank 60A can be effected through the lower adjusting and sealing means 160. To this end, a plurality of studs 201 are threadedly engaged in the annular ring 76A. Surrounding each of the studs 201 is a tubular adjusting screw 202 which extends through suitable openings 203 provided in the closure plate 164. Thus, by selective adjustment of the adjusting screws 202, the entire assembly of closure plate 164, support base 161, support member 191 and storage tank may be moved vertically either upwardly or downwardly as may be required. With storage tank 60 positioned as required, it will be locked in its adjusted position by means of nuts 204. The nuts 204 are threadedly engaged against the surfaces of the head portion 206 of the adjusting screws 202. Since the depending collar 162 of the support base 161 has sliding engagement with the annular ring 76A, the O-ring 163 will operate to maintain the gas tight seal between the members. The bellows 152 associated with the upper adjusting and sealing means 130 will accommodate the vertical movement of the storage tank 60A as accomplished through the lower adjusting and sealing means 160.

From the foregoing detailed description of the adjusting and sealing means set forth, it is apparent that a versatile and unique arrangement has been provided for gas insulated circuit breaker units. The arrangement provides unique adjusting capabilities for facilitating the alignment and connections of the various components in a relatively restricted enclosure.

The embodiments of the invention in which an exclusive property or privilege is claimed are defined as follows:

1. In a gas insulated circuit breaker having an interrupter which is provided with a blast of high pressure gas from a blast valve unit;

a storage tank (60A) of an insulating material having gas at a relatively high pressure therein;

support means including a base (101A) having an axially extending threaded portion threadedly connected to one end of said storage tank in gas tight relationship; and, adjusting means comprising a lower collar ring (131) disposed on said support means in gas tight relationship for radial movement relative to said support means also including an upper collar ring (139) in gas sealing relationship with said blast valve unit, said upper collar ring (139) also being radially movable relative to said blast valve unit; a bellows (152) connected in gas tight relationship to said lower and upper collar rings to form a gas flow passage between said storage tank and said gas blast valve unit, said adjusting means being operable to receive and connect the blast valve unit to said storage tank in any radially adjusted position.

2. In a gas insulated circuit breaker including a gas tight enclosure having therein an interrupter and an associated blast valve unit (55) operable to direct a blast of gas at a relatively high pressure to the arcing area of the interrupter;

a cylindrical storage tank (60) of an insulating material having gas at a relatively high pressure therein, said storage tank being disposed within the enclosure of the circuit breaker;

support means (101) connected in gas tight relationship to one end of said storage tank and to the blast valve unit in gas flow relationship;

adjusting means operably connected to the blast valve unit and to said support means, said adjusting means including a plurality of individually adjustable tubular screws (111) threadedly connected to the blast valve unit (55) and disposed in abutting engagement with said support means (101) whereby manipulation of said tubular screws in a selected direction will effect relative axial positioning movement between said blast valve unit relative to said storage tank;

means operable to secure the blast valve unit to said support means including a plurality of threaded studs (116), said studs being individually inserted through associated ones of said tubular screws and into threaded engagement in said support means and extending outwardly from the free end of said tubular screws; and, nut members (119) threadedly engaged on the extending free ends of said studs into force applying engagement with the axial free end of said tubular screws.

3. In a gas insulated circuit breaker including a gas tight enclosure having therein an interrupter and an associated blast valve unit operable to direct a blast of gas at a relatively high pressure to the arcing area of the interrupter;

a cylindrical storage tank of an insulating material having gas at a relatively high pressure therein, said storage tank being disposed within the enclosure of the circuit breaker and having one end thereof connected to the blast valve unit in gas flow relationship;

a support base carried by the enclosure for radial movement, said support means having a spherical surface;

securing means operably connected to the enclosure and to said support base to secure said support base within the enclosure;

a support member connected in gas tight relationship to the end of said storage tank, said support member having a spherical surface complementary to the spherical surface of said support base, said support member being constructed and arranged to mate with said support base;

sealing means operable to effect a gas tight seal between the mating surfaces of said supporting base and said support member; and, clamping means operably connected to clamp said support member to said support base in an adjusted position of the support member on said support base;

whereby the support member may be adjusted on said support base in any radial direction to thereby vary the angular location of the axis of said storage tank.

4. A gas insulated circuit breaker according to claim 3 wherein the spherical surface on said support base is convex; and, the complementary surface of the support member is concave.

5. In a gas insulated circuit breaker (10) including a gas tight enclosure (11) having therein an interrupter (36) and an associated blast valve unit (155A) having a flange operable to direct a blast of gas at a relatively high pressure to the area of arcing of the interrupter;

a cylindrical storage tank (60A) of an insulating material having gas at a relatively high pressure therein, said storage tank being disposed within the enclosure of the circuit breaker;

mounting means (162-191) connected to one end of said storage tank in gas tight relationship and operable to mount said storage tank within the enclosure;

a mounting base (101A) secured to the other end of said storage tank in gas tight relationship and having an opening the axis of which coincides with the axis of said storage tank;

a bellows (152) connected in gas tight and gas flow relationship between the opening in said mounting base (101A) and the blast valve unit;

adjusting means extending between said mounting base and the blast valve unit and operable to effect relative axial positioning adjustment between the blast valve unit (55A) and said storage tank, said adjusting means including a lower collar ring (131) mounted in gas tight and gas flow relationship on said mounting base and for radial positioning movement relative to said mounting base;

said adjusting means also including an upper collar ring (139) disposed in gas sealed and gas flow relationship with said blast valve unit, said upper collar ring also being radially positionable relative to said blast valve unit;

a plurality of spaced apart threaded studs (132) secured in spaced relationship in said mounting base (101A) and extending therefrom through enlarged openings provided in the flange of said blast valve unit and said lower and upper collar rings the openings being larger in diameter than the diameter of said studs to thereby permit radial positioning movement of said storage tank relative to said blast valve unit;

a bellows connected between said upper and lower collar rings in gas tight and gas flow arrangement;

nut members (137-146) to clamp said upper collar ring (139) in radial adjusted position relative to the flange of the blast valve unit; and, other nut members (134) engaged on said studs and operable to clamp said lower collar ring (131) on said mounting base in a radial adjusted position.

6. In a gas insulated circuit breaker including a gas tight enclosure having therein an interrupter and an associated gas blast valve unit operable to direct a blast of gas at a relatively high pressure to the arcing area of the interrupter;

a cylindrical storage tank of an insulating material having gas at a relatively high pressure therein, said storage tank being disposed vertically within the enclosure of the circuit breaker;

means connecting the upper end of said storage tank in gas tight and gas flow relationship to said blast valve unit;

a support base slidably supported in gas tight relationship for vertical adjusting movement in the circuit breaker enclosure, said support base being provided with a depending circular collar that extends outwardly of the enclosure in gas tight relationship;

a plate member operable to cover the opening defined by said depending collar and extends radially beyond the external surface of said collar;

first securing means for securing said plate member to the external axial end of said collar;

securing means operably connected to secure said supporting base in an adjusted vertical position in the enclosure, including a plurality of threaded studs passing through spaced apart openings formed in the radial edge of said plate member that extends beyond said collar, said studs being threadedly engaged in said enclosure;

spacers surrounding each of said studs and disposed in abutting engagement with the enclosure;

a nut threadedldy engaged on the extending end of each of said studs and operable to engage the adjacent axial end of an associated spacer;

a support member connected in gas tight relationship to one end of said storage tank and disposed on said support base to support said storage tank on said support base; and, securing means operably connected to secure said support member on said base;

whereby the vertical position of said storage tank may be adjusted by axially adjusting said spacers.

7. A gas insulated circulated circuit breaker according to claim 6 wherein said support member is disposed on said support base for radial adjusting movement; and, said securing means is operable to secure said support member in a radially adjusted position on said support base.

8. In a gas insulated circuit breaker (10) including a gas tight enclosure (11) having therein an interrupter (36) and an associated gas blast valve unit (55) operable to direct a blast of gas at a relatively high pressure to the area of arcing of the interrupter;

a cylindrical storage tank (60) of an insulating material having gas at a relatively high pressure therein, said storage tank being disposed within the circuit breaker enclosure;

a supporting base structure (66–68) adapted to receive the lower end of said storage tank in gas tight relationship, said supporting base structure being operably mounted to the circuit breaker enclosure for supporting said storage tank in the enclosure for bodily radial shifting movement in any direction and for adjusting the angle of inclination of the axis of the said storage tank in any direction; and, a support member (101) connected in gas tight relationship to the upper end of said storage tank and to the blast valve unit in gas flow relationship, said support member including means (106) operable to maintain the gas tight and gas flow relationship between the blast valve unit and said storage tank upon bodily radial shifting movement of said storage tank, said support member further including means (111) for effecting bodily adjustment of the blast valve unit relative to said storage tank in directions parallel to the axis of said storage tank.

9. In a gas insulated circuit breaker (10) including a gas tight enclosure (11) having therein an interrupter (36) and an associated gas blast valve unit (55) operable to direct a blast of gas at a relatively high pressure to the area of arcing of the interrupter;

a cylindrical storage tank (60) of an insulating material having gas at a relatively high pressure therein, said storage tank being disposed vertically within the circuit breaker enclosure;

a supporting base structure (161–191) adapted to receive the lower end of said storage tank in gas tight relationship, said supporting base structure being operably mounted to the circuit breaker enclosure for supporting said storage tank for bodily radial shifting movement in any direction and for vertical bodily adjusting movement; and, a support member (101A) connected in gas tight relationship to the upper end of said storage tank, said supporting member including a flexible portion (152) operable to provide a gas flow relationship between said storage tank and the blast valve unit, said support member also including means (139–153 and 131–106A) operable to maintain the gas tight and gas flow relationship between said storage tank and the blast valve unit upon bodily radial shifting movement of said storage tank and upon bodily vertical movement of said storge tank in either direction, said support member further including means (132, 134, 137, 138, 147, 146) for adjusting the angular orientation of said storage tank and relative to said blast valve unit.

* * * * *